United States Patent [19]

Cardinale et al.

[11] 4,158,278

[45] Jun. 19, 1979

[54] INSULATING GLASS PANE ASSEMBLY

[76] Inventors: Raffaele Cardinale, Im Hackacker, CH-8902 Urdorf; Jakob Kuchler, Pappelstrasse 22, CH-8305 Dietlikon, both of Switzerland

[21] Appl. No.: 792,093

[22] Filed: Apr. 29, 1977

[30] Foreign Application Priority Data

May 20, 1976 [CH] Switzerland ..... 6324/76

[51] Int. Cl.[2] ..... E06B 5/20; E04C 2/54

[52] U.S. Cl. ..... 52/790; 428/34

[58] Field of Search ..... 52/172, 398, 397, 616, 52/308, 790, 171; 428/34

[56] References Cited

U.S. PATENT DOCUMENTS

| | | | |
|---|---|---|---|
| 2,781,561 | 2/1957 | Gifford et al. | 52/397 |
| 2,838,809 | 6/1958 | Zeolla et al. | 52/172 |
| 2,877,516 | 3/1959 | Bobel | 52/172 X |
| 3,167,823 | 2/1965 | Palfey | 52/172 |
| 3,775,914 | 12/1973 | Patil | 52/172 |
| 3,928,953 | 12/1975 | Mazzoni et al. | 52/172 |
| 3,971,178 | 7/1976 | Mazzoni et al. | 52/616 X |
| 3,998,680 | 12/1976 | Flint | 52/616 X |
| 4,019,295 | 4/1977 | Derner et al. | 52/172 X |

FOREIGN PATENT DOCUMENTS

| | | | |
|---|---|---|---|
| 1227943 | 4/1971 | United Kingdom | 52/397 |

*Primary Examiner*—Alfred C. Perham

*Attorney, Agent, or Firm*—Tilton, Fallon, Lungmus & Chestnut

[57] ABSTRACT

An insulating glass pane assembly and its use. The assembly includes at least two panes of glass sealingly connected to each other and held apart from each other by a crosspiece attached on the perimeters thereof. The crosspiece is provided with at least one layer of sound-reducing material attached in such a way that it prevents the transmisson of sound from pane to pane by way of the crosspiece. The assembly can be used to produce windows by providing a window pane having grooves therein disposed in such a way that they receive and retain the panes of glass within the window frame. A sound-reducing material is attached in the grooves to insulate the panes of glass on all sides against the window frame in a sound-reducing manner. The assembly is completed by installing the panes of glass in the grooves in the window frame. With these features, the insulating glass pane assembly and its use successfully prevent the transmission of sound from pane to pane by way of the crosspieces.

2 Claims, 4 Drawing Figures

INSULATING GLASS PANE ASSEMBLY

BACKGROUND AND SUMMARY

The present invention relates to an insulating glass pane assembly consisting of at least two panes sealingly connected to each other and held apart from each other by crosspieces attached to the perimeter.

Insulating glass pane assemblies have been known for a long time; there are those where the panes are fused to each other air-tight at the edges whereas the space between the panes is filled with an inert dry gas. On the more common type, the panes are kept apart by means of a crosspiece; here the panes and the crosspieces are fused to each other or are connected with one another by a two-component adhesive-sealing material. On these insulating panes with crosspieces, the latter are designed mostly as hollow profiles which contain a drying material, for instance, silicagel, so that the panes will not fog. To be sure, the sealing material should be as steam-blocking as possible; but in the long run, a little humid air always gets between the two panes.

All well known insulating glass pane assemblies serve for the heat insulation of window panes. The invention is based on the problem to develop an insulating glass pane assembly which has not only heat-insulating but simultaneously better sound reducing properties than those of glass pane assemblies of this type known up to now. It is true, insulating glass pane assemblies known up to now reduce somewhat the noise of vehicles and airplanes caused by traffic; however, a better sound insulation is highly desirable.

The invention solves this problem on an insulating glass pane assembly which is provided with crosspieces, by the fact that the crosspieces are provided with at least one layer of sound reducing material. The sound reducing material is attached in such a way that it prevents the transmission of sound from pane to pane by way of the crosspieces, and it should preferably be steam-blocking.

DRAWINGS

In the drawing, several embodiments of the object of the invention are illustrated and its utilization for the production of windows is explained:

DESCRIPTION

Figure 1:
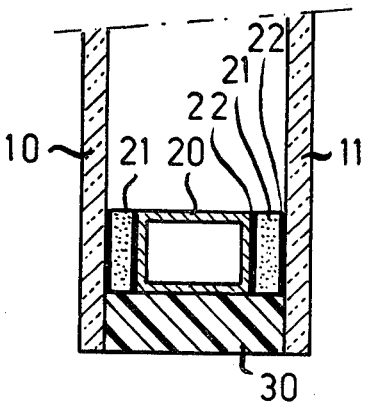
FIGS. 1–3 show a sectional view of window glass panes.

In FIG. 1, 10 and 11 signify two glass panes and 20 is a crosspiece which is designed as a hollow section of aluminum. In the hollow section there is drying material which is not shown for reasons of clearness. Between each of the panes 10, 11 and the cross piece 20 there is a strip of sound reducing, steam-tight material 21. The connection between the panes 10, 11, the crosspiece 20 and the strip 21 of sound reducing material is produced with an adhesive material 22. The assembly is sealed by means of a two-component sealing material 30.

As examples of suitable materials, a copolymeride of ethylene vinyl acetate (EVA) is to be considered for the sound reducing steam-tight material which, for instance, is commercially available under the name TEROFORM 6011 (trademark), and butyl is to be considered as a two-component adhesive for the sealing material which, for instance, is commercially available under the name TEROSTAT 990 (trademark).

It is important that the sound-reducing material itself be as impervious to steam as possible since the sealing material still lets 2.6 $g/m^2/24h$ moisture get through. However, the sound-reducing material TEROFORM 6011 allows only 0.25 $g/m^2/24h$ get through. For reasons of clearness, the thickness of the butyl layer 22 is illustrated in a very exaggerated manner in the drawing, although in practice it is only about 0.2 mm. The sound-reducing material, however, should be at least 2 mm thick.

Figure 2:
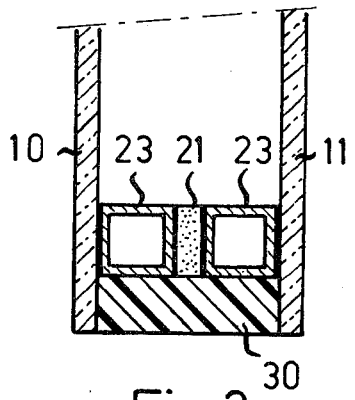

The insulating glass pane assembly shown in FIG. 2 differs from that according to FIG. 1 only by the fact that the sound-reducing material 21 is attached here between two narrower crosspieces 23.

Figure 3:
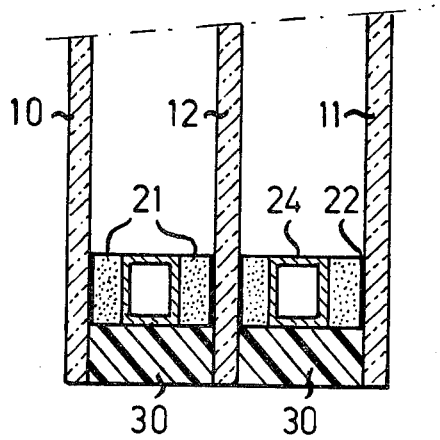

In FIG. 3 there is illustrated in place of an insulating glass pane assembly with double glazing as in FIGS. 1 and 2 such an insulating glass pane assembly with triple glazing. Furthermore, here the sound-reducing steam-tight layer 21 is extruded onto the crosspieces 24. This simplifies the construction of the insulating glass pane assembly since only the panes 10, 11, 12 have to be glued to the crosspieces which are prefabricated in this manner. Such prefabricated crosspieces provided with a sound-reducing layer extruded onto them can be used also for the insulating glass pane assemblies according to FIGS. 1 or 2.

Figure 4:
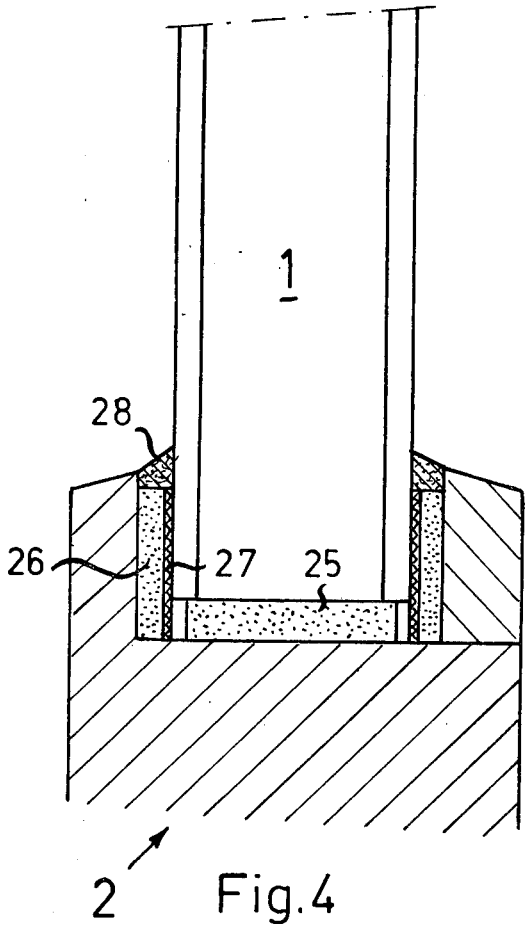
FIG. 4 shows the use of such a glass pane for a window.

So that the better sound-reducing characteristic of the insulating glass pane assembly achieved by its construction will not be lost by incorrect installation in the window frame, sound-reducing material must also be used here. Correct use is shown in FIG. 4, where, for instance, an insulating glass pane assembly 1 according to FIG. 1 is installed in the window frame 2 with the insulating glass pane assembly 1 being supported on blocks 25 of sound-reducing material. Laterally, there are also attached strips of sound-reducing material 26 which are provided with strips 27 of tape put on beforehand with tape strips 27 for this purpose preferably being so-called Mappa tape, a polyethylene foam strip with closed pores, self-sticking on one side. The assembly is then sealed with non-hardening putty 28.

While in the foregoing specification a detailed description of the invention has been set forth for purposes of illustration, variations of the details herein given may be made by those skilled in the art without departing from the spirit and scope of the invention.

We claim:

1. An insulating glass pane assembly comprising at least two parallel spaced-apart sheets of glass separated by a crosspiece, a layer of sound-reducing material between said crosspiece and each of said glass sheets, said crosspiece and said layers of sound-reducing material being spaced inwardly from the peripheral edges of said glass sheets to provide an outwardly open channel around the peripheral edges of the glass sheet, the height of said channel being approximately equal to the height of said crosspiece and said layers of sound-reducing material, said open channel being filled with sealing material.

2. The assembly of claim 1 in which each of said layers of sound-reducing material is adhesively secured to the adjacent glass sheet.

* * * * *